United States Patent [19]

Covell

[11] Patent Number: 4,966,793

[45] Date of Patent: Oct. 30, 1990

[54] DECORATIVE WALL HANGING

[76] Inventor: O. Dexter Covell, 800 Gleason Ave., Langley, Wash. 98260

[21] Appl. No.: 367,980

[22] Filed: Jun. 19, 1989

[51] Int. Cl.[5] ..... A47G 33/06; B44F 1/00

[52] U.S. Cl. ..... 428/7; 362/226; 362/252; 362/806; 428/9; 428/12; 428/131; 428/904.4

[58] Field of Search ..... 362/226, 252, 806; 428/7, 9, 12, 131, 904.4; 296/97.7

[56] References Cited

U.S. PATENT DOCUMENTS

| | | | |
|---|---|---|---|
| 3,191,020 | 6/1965 | Miller | 362/252 X |
| 3,607,582 | 9/1971 | Horacek | 428/7 X |
| 4,202,396 | 5/1980 | Levy | 160/107 |
| 4,363,081 | 12/1982 | Wilbur | 428/901 X |
| 4,537,806 | 8/1985 | Sherrard | 428/7 |
| 4,657,800 | 4/1987 | Long | 428/904.4 X |
| 4,667,276 | 5/1987 | Cheng | 362/252 X |
| 4,751,115 | 6/1988 | Smith et al. | 296/97.7 X |

*Primary Examiner*—Henry F. Epstein

[57] ABSTRACT

A decorative wall hanging that compresses to a compacted storage position and expands to a flat hanging position having inwardly and outwardly facing surfaces, an artistic design on the outwardly facing surface, ornament positioning holes within the outline of the artistic design which pass between the inwardly and outwardly facing surfaces, and a guide on the inwardly facing surface for using the ornament positioning holes in sequence, the holes being of such size and shape to restrainably hold ornaments.

6 Claims, 1 Drawing Sheet

DECORATIVE WALL HANGING

BACKGROUND

1. Field of Invention

This invention relates to wall hangings used for decorative purposes, and more specifically to a decorative wall hanging having the design of an object such as a Christmas tree on its outwardly facing wall hanging, a series of openings through the surface adapted to receive and hold ornamental devices such as electric lights, and instructions for properly installing the ornamental devices in proper order on its inwardly facing surface, the entire wall hanging being designed to stretch flat to hang on a wall or to compress to a smaller size for storage.

2. Description of Prior Art

It has become the widely accepted practice for those who celebrate a specific holiday, such as Christmas, to decorate their houses with a tree erected in one of its principal rooms. In the case of Christmas, it is traditional to use an evergreen tree for this purpose, and for centuries such trees have been grown and cut down or dug up live, transported to a selling area, and bought and brought home by the celebrants. Due to the nature of the marketplace, this has often resulted in either a large glut or shortage of such trees available at Christmas, and it has always resulted in a disposal problem after the holiday of enormous proportions.

There have been further problems caused by the trees drying out indoors and losing their needles or becoming fire hazards, and as a result of this, starting in the 1960ties, imitation trees of a plastic such as polyvinyl chloride were introduced and have become popular. While resolving many of the former problems, these plastic trees are expensive, require careful and bulky storage, and have to be carefully and time consumably erected for use. As house rooms continue to become smaller and more crowded with furniture, the main problem with plastic trees as with natural trees, is that they require a considerable amount of floor space for their use and this often is not possible, or at the very best causes inconvenience.

In an effort to deal with this space problem, designs of half-round trees made of plastic have been recently introduced. These half-round trees are designed to hang on a wall, and as a result the space problem has been alleviated but the problems of storage and erection persist.

It was against this background that the present invention was developed as a wall hanging to use no floor space whatsoever, to be foldable or rollable for compact storage, and to be quickly flattened and hung on a wall when taken from storage. These characteristics would be typical of nearly any wall hanging, and in fact, wall hangings with Christmas tree designs have been available recently with small ornaments and lights hanging from their surface. The problem with any such tree, however, is one of appearance, because the lights commonly used to decorate Christmas trees are made as sets of lights connected by electric wires, and when the lights are hung on the tree surface, the wires detract from the visual appearance and have been difficult to position and control.

This present invention solves this problem by providing a series of carefully spaced and sized holes through its surface, which holes receive and position the lights which are inserted in them from the inwardly facing surface of the wall hanging. Thus the lights are held in the outwardly facing surface of the tree in exactly the desired position, and the wires connecting them are concealed behind the wall hanging.

In a preferred embodiment of this invention, corrugated cardboard sheet is adapted as the basic material for the wall hanging. This material has the advantages of being of sufficient rigidity to support the lights when inserted into their corresponding holes, is relatively inexpensive, can be fabricated on presently available equipment, can be printed or screened on both sides, is durable, and can easily be folded down to a compressed size for storage. The use of such a material as an automobile sunshield is taught in U.S. Pat. No. 4,202,396 to Abraham Levy and it has proven both popular and practical in such products, although no suggestion of its use as a foldable wall hanging is made there or elsewhere.

OBJECTS AND ADVANTAGES

Accordingly, beside the advantages of providing an artistically designed wall hanging that uses no floor space and can be compactly stored, other objects and advantages of the present invention are:

(a) to provide a wall hanging that can be easily fabricated on existing equipment from readily available material.

(b) to provide a wall hanging that can be easily printed, painted, or screened with virtually any design in any color or combination of colors.

(c) to provide a wall hanging that can easily and quickly be compressed for storage.

(d) to provide a wall hanging that can be taken out of storage and in a short period of time be hung on a wall and decorated.

(e) to provide a wall hanging that can be decorated with the authentic objects generally and customarily used for decoration.

(f) to provide a wall hanging wherein the unsightly elements of decorations are concealed behind the wall hanging.

(g) to provide a wall hanging where the decorations are prepositioned to compliment the overall design.

(h) to provide a wall hanging with permanent installation instructions for decoration in a trouble-free manner.

(i) to provide a wall hanging that can be produced and sold relatively inexpensively.

(j) to provide a wall hanging that is durable and can be used year after year.

Further objects and advantages will become apparent from a consideration of the ensuing description and drawings.

DESCRIPTION - FIGS. 1 TO 4

Figure 1:
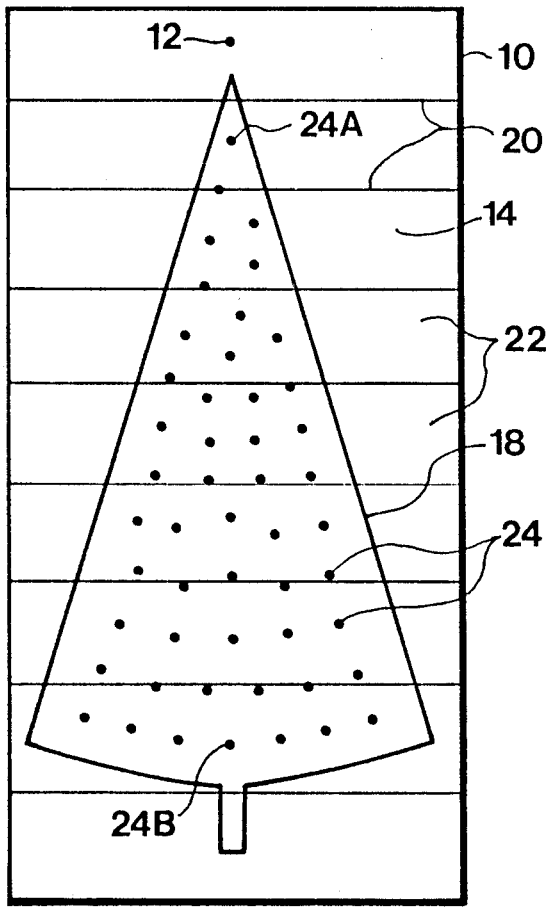
FIG. 1 shows the outwardly facing side of a preferred embodiment of the wall hanging with a Christmas tree design.
Figure 2:
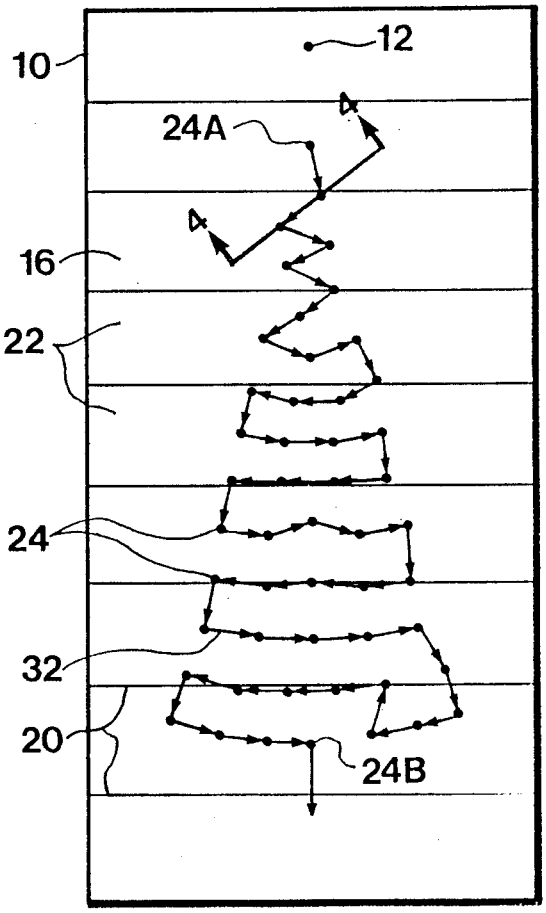
FIG. 2 shows the inwardly facing side of the wall hanging with ornament positioning instructions.
Figure 3:
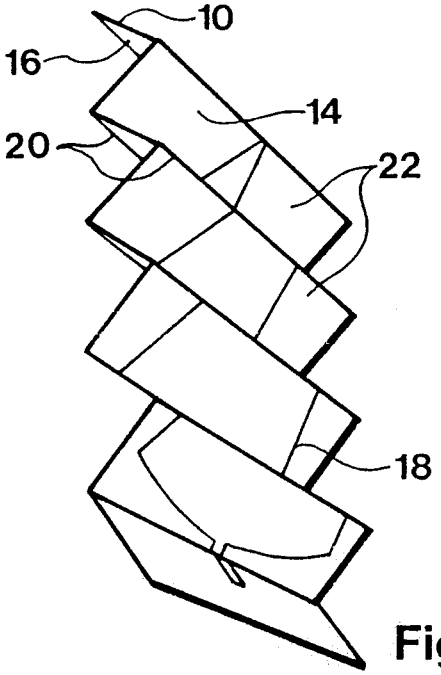
FIG. 3 shows the preferred embodiment of the wall hanging in a partially compressed position.
Figure 4:
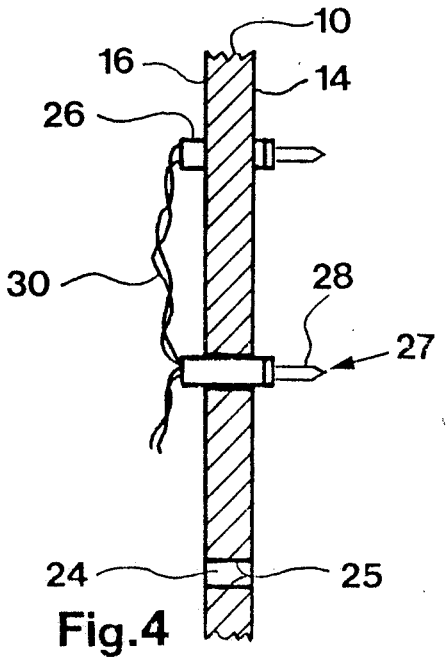
FIG. 4 shows an enlarged partial section taken on the line 4–4 of FIG. 2 through a typical light installation.

The preferred embodiment of the present invention as illustrated shows a sheet of corrugated cardboard 10 employed for the wall hanging. Other materials could just as easily be used, provided that the materials must have sufficient rigidity to support the ornaments to be hung thereon without distortion or unwanted puckering of the material. Examples of material which have proven satisfactory in use include corrugated cardboard of such rigidity that it resists being rolled up as well as corrugated cardboard which can be rolled up, and various heavy-weight paper and plastic sheet materials. A corrugated cardboard of substantial rigidity is, however, preferred because it has strength and durability, is easily screened or printed in production, and is economical.

Cardboard corrugated material is generally manufactured in sheets which are ideally suited to hang flat on a wall, but are of such rigidity that they must be adapted to fold into a compressed position for storage in a compact fashion. To this end a series of parallel scores or creases 20 is made on the sheet material 10 to divide it into several planar elements 22 which are connected to and jointed to each other across or through the scores or creases 20.

To fold the wall hanging for storage, adjacent planar elements 22 rotate in opposite directions around the scores or creases 20 which join them in what is generally known as "accordion" fashion, so that when fully compressed the planar elements 22 are in a folded position and lie flat against each other to reduce the wall hanging to a minimum size for storage. If the material used is less rigid and of sufficient flexibility to be rolled up into a compact cylinder, compression of the wall hanging for storage can be accomplished in that manner and there would be no need to provide the scores or creases 20 or to divide the sheet material into planar elements 22.

To prepare the wall hanging to hang flat on a wall from its compressed or stored position, the folded wall hanging is unfolded to form as flat a surface as possible. If the material has been in a folded position for a period of time it may be necessary to gently force each adjacent pair of panels in a rotational direction opposite to their folded positions so that they will spring back to a substantially flat position. If the wall hanging is stored rolled up, it may likewise be necessary to roll it gently in an opposite direction.

The wall hanging is adapted to hang on a wall providing a hole 12 in its upper margin which can accommodate a wall hanger of any usual design. Other hanging means could be employed such as a horizontal rod, or the material could simply be tacked to the wall. In any case, once it is hung the material defines an outwardly, or room, facing surface 14 on one side and an inwardly, or wall, facing surface 16 on the opposite side.

An artistic design 18 is screened onto the outwardly facing surface 14. As shown, this is in the shape of a Christmas tree, although a design of any object could be used to accommodate any particular holiday or design criteria. Within the outline of this design 18, a series of positioning means in the form of spaced holes 24 is provided which pass entirely through the material between the outwardly facing surface 14 thereof and the inwardly facing surface 16 thereof, each hole defining at least two opposing walls 25. These holes are of restricted cross-sectional dimension of such size that the opposing walls 25 thereof contact and restrainably hold at least one element of a decorative ornament. Although these ornaments could be any customary type made of glass, plastic, or wood for example, in the preferred embodiment of this invention they are in the form of a string of miniature electric light fixtures joined by electric wires terminating at one end in a male plug. Such lights are made for indoor use and are readily available from many manufacturers and stores and are known generally as midget, mini, or miniature lights of low amperage. They are characteristically of simple design and each light 27 is composed of a barrel section 26 into which an electric light bulb 28 is inserted, each barrel section being connected by electric wires 30 to its adjacent light or lights to from a continuous string of such lights. If the length of the wires 30 between adjacent lights 27 measures approximately 6", the holes 24 should be no more than 5" apart to permit easy installation and avoid stressing the wires.

As seen in the drawings, the opposing walls 25 of each of the holes 24 contact the outside surface of the barrel 26 of a light 27 which is one of a string of lights and restrains the axial movement of that barrel 26. If the diameter of a barrel approximates 11/32", for example, holes of 5/16" would be drilled, diecut, or punched to provide sufficient space between the opposing walls for forced entry of such a barrel and at the same time restrain its further movement.

On the reverse, or inwardly facing surface 16 of the wall hanging, guiding means are provided in order that the individual lights of the string of lights can be inserted in the proper sequence so that all the lights on the string can be used and the connecting wires 30 do not cross over each other but instead form a continuous progression to cover the entire design on the outwardly facing surface 14. These guiding means could take the form of a sequence of numbers, but as shown in the preferred embodiment of this invention, they are in the form of arrows 32 starting from the uppermost hole 24A and progressing down to the centrally located lowermost hole 24B directly above the tree trunk. When the string of lights is installed by inserting the light 27 at the extreme end of the string of lights opposite the plug end in that uppermost hole 24A, and the arrows are followed from hole to hole, the last light of the string of lights will insert into the centrally located bottom hole 24B and the plug end will be in position to be plugged into an electric wall socket in the least visible manner. On a Christmas tree design approximately 5 feet tall, a string of 50 lights has been found to cover the tree design area attractively and fewer or more lights can be used on smaller or larger trees.

INSTALLATION

To install or "put up" the wall hanging described from its stored or compressed position, it is first necessary to stretch or open its planar elements 22 as far as possible and then to gently bend the planar elements 22 around their joints 20 in a reverse rotation or direction so that when released the planar elements 22 are generally aligned in a common plane. If the wall hanging is stored in a rolled up position, it is likewise necessary to straighten it out to lie flat by gently re-rolling it in the reverse direction.

Once the wall hanging is flat, and the ornamental devices chosen to be used are a string of electric lights, the wall hanging should be spread on the floor upside down with its inwardly facing surface 16 facing up, and the light 27 at the extreme or free end of the string of lights should be gently forced in between the opposing walls 25 of the uppermost hole 24A. Then, one by one, following the numbers or the arrows 32 each light in sequence should be inserted in its appropriate hole until the last light 27 is inserted in the lowermost hole 24B. When inserting a light, care should be exercised to insert the light just far enough into the hole 24 so that the opposing walls 25 can grip the barrel 26.

At this point, the wall hanging may be hung on a wall using its hanging hole 12 or any other suitable hanging means, and the light string plugged into any convenient wall outlet thereby activating the lights. If individual lights or other ornaments had been used instead of the string of lights, the wall hanging could, of course, have been hung on the wall once it was flattened out and the lights or other ornaments inserted directly from the outwardly facing surface 14.

Further decoration of the design with other types of ornaments is not only possible but is anticipated as an integral part of this invention.

If it is desired to do so, once the wall hanging has been hung on the wall, ornaments can be easily installed using the wire ornaments hangers normally employed in decorating a natural or plastic Christmas tree. Working from the outward facing surface 14, the hook end of the hanger is forced through or into the wall hanging material at whatever position is desired. If the surface is difficult to penetrate, a nail or other pointed instrument can be used first to make a starter hole.

SUMMARY

Accordingly, it can be seen that the decorative wall hanging of this invention accomplishes the stated objects in that it provides a wall hanging that:

(a) can be artistically designed
(b) is easily storable
(c) conserves floor space
(d) is quickly installed
(e) can be decorated to an individual's taste
(f) can be economically produced and sold
(g) can be used year after year
(h) is easily transportable
(i) facilitates the placement of ornaments
(j) uses customary and familar ornaments.

Although the description above contains specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. In a decoration, the improvement comprising in combination:

a wall hanging fabricated from sheet material having a compacted position for storage and a stretched position for hanging substantially flat on a wall with an outwardly facing surface and an inwardly facing surface, an artistic design on said outwardly facing surface, and ornament positioning means in said artistic design passing between said inwardly and outwardly facing surfaces comprising a plurality of holes, each of said holes being sized to restrainably hold an ornamental light fixture of an electrically connected string of such light fixtures inserted into said hole from said inwardly facing surface to project through said outwardly facing surface, said holes being located closer together than the length of said electrical connection between adjacent light fixtures.

2. A decoration as claimed in claim 1, wherein; said sheet material has a plurality of parallel folds dividing it into planar elements jointed to each other through said folds along the edges thereof, said planar elements folding along said folds in alternate rotative directions to said compacted position.

3. In a decoration, the improvement comprising in combination:

a wall hanging fabricated from sheet material having a compacted position for storage and a stretched position for hanging substantially flat on a wall with an outwardly facing surface and an inwardly facing surface, an artistic design on said outwardly facing surface, ornament positioning means in said artistic design passing between said inwardly and outwardly facing surfaces comprising a plurality of holes, each of said holes being sized to restrainably hold an ornamental light fixture of an electrically connected string of such light fixtures inserted into said hole from said inwardly facing surface to project through said outwardly facing surface, said holes being located closer together than the length of said electrical connection between adjacent light fixtures, and guiding means on said inwardly facing surface indicating the sequence for inserting said light fixtures into said holes.

4. A decoration as claimed in claim 3, wherein; said sheet material has a plurality of parallel folds dividing it into planar elements jointed to each other through said folds along the edges thereof, said planar elements folding along said folds in alternate rotative directions to said compacted position.

5. A decoration as claimed in claim 3, wherein; said guiding means comprises a series of individual arrows each of which originates at one of said holes and terminates at the next adjacent hole.

6. A wall hanging fabricated from substantially rigid sheet material comprising in combination:

a plurality of parallel folds dividing said sheet material into planar elements jointed to each other through said folds along the edges thereof, said planar elements folding along said folds in alternate rotative directions to a compacted position for storage and a stretched position for hanging substantially flat on a wall with an outwardly facing surface and an inwardly facing surface, a decorative design on said outwardly facing surface, ornament positioning means in said decorative design passing between said inwardly and outwardly facing surfaces comprising a plurality of holes, each of said holes having opposing side walls in restrainable contact with the barrel portion of an ornamental light fixture of an electrically connected string of such light fixtures, said holes being located closer together than the length of said electrical connection between adjacent light fixtures, and guiding means on said inwardly facing surface indicating the sequence for inserting the light fixtures into said holes from said inwardly facing surface to project through said outwardly facing surface.

* * * * *